US007984927B2

(12) United States Patent
Kim

(10) Patent No.: US 7,984,927 B2
(45) Date of Patent: Jul. 26, 2011

(54) SECRET SCRATCH STICKER AND METHOD OF MANUFACTURING THE SAME

(76) Inventor: Seong Hun Kim, Seoul (KR)

( * ) Notice: Subject to any disclaimer, the term of this patent is extended or adjusted under 35 U.S.C. 154(b) by 462 days.

(21) Appl. No.: 12/114,450

(22) Filed: May 2, 2008

(65) Prior Publication Data

US 2009/0224528 A1 Sep. 10, 2009

(30) Foreign Application Priority Data

Mar. 4, 2008 (KR) ..... 10-2008-0019907

(51) Int. Cl.
*B42D 15/10* (2006.01)
*B42D 15/00* (2006.01)

(52) U.S. Cl. ..... 283/100; 283/72; 283/84; 283/95; 283/98; 283/94; 283/101; 283/901; 283/903

(58) Field of Classification Search ..... 281/2, 5, 281/51; 283/49, 56, 61, 62, 72, 84, 91, 94, 283/95, 98, 100, 101, 109, 114, 117, 901, 283/903; 412/8
See application file for complete search history.

(56) References Cited

U.S. PATENT DOCUMENTS

| | | | | |
|---|---|---|---|---|
| 4,702,496 | A * | 10/1987 | Hume, III | 412/8 |
| 4,938,830 | A * | 7/1990 | Cannistra | 283/109 |
| 5,421,583 | A * | 6/1995 | Gluck | 283/117 |
| 2007/0164559 | A1 * | 7/2007 | Kozdras | 283/100 |
| 2008/0252064 | A1 * | 10/2008 | Sekine et al. | 283/91 |

FOREIGN PATENT DOCUMENTS

KR 20-0276308 5/2002

* cited by examiner

*Primary Examiner* — Dana Ross
*Assistant Examiner* — Justin V Lewis
(74) *Attorney, Agent, or Firm* — Akerman Senterfitt

(57) ABSTRACT

Disclosed herein is a secret scratch sticker capable of secretly delivering a message to only a person who receives the message and a method of manufacturing the same. The secret scratch sticker comprises a transparent film sheet 110 having an adhesion portion formed on one surface thereof; a first scratching part 120 laminated on the other surface of the film sheet 110 so as to be stripped off with a fingernail or a coin; and a second scratching part 130 laminated on the first scratching part 120 so as to be stripped off together with the first scratching part 120, the second scratching part having colors. According to the present invention, a user can deliver a message to only a desired person, and thus the message can be hidden from other people.

2 Claims, 6 Drawing Sheets

SECRET SCRATCH STICKER AND METHOD OF MANUFACTURING THE SAME

BACKGROUND OF THE INVENTION

1. Field of the Invention

The present invention relates to a secret scratch sticker and a method of manufacturing the same, and more particularly, to a secret scratch sticker for secretly delivering a message to only a person who is expected to receive the message and a method of manufacturing the same.

2. Background of the Related Art

Generally, when a person sends a letter or a post card, the person puts the letter in an envelope and sends it in order to prevent people other than a person who is expected to receive the letter from reading the contents of the letter. In particular, when a person wants to deliver a special message to a lover or a secret massage to somebody, it is more important to maintain the secret of the message contained in the letter.

However, delivering a message using an envelope cannot be a perfect method for maintaining the secret of the message contained in the letter. That is, people can read the contents of the letter just by opening the envelope, and then they can re-seal the opened envelope or replace the envelope with another one.

To solve this problem, there has been produced a card coated with scratching ink such as an instant lottery ticket. However, the card coated with the scratching ink becomes easily dirty when a finger touches the surface of the card on which the scratching ink is coated.

Furthermore, the scratching ink is easily scratched off only by a weak force, and thus the scratching ink is undesirably removed.

Moreover, the color of the scratching ink is monotonous because it is limited to a gold or silver color.

SUMMARY OF THE INVENTION

Accordingly, the present invention has been made in view of the above-mentioned problems occurring in the prior art, and it is a primary object of the present invention to provide a secret scratch sticker for secretly delivering a message including a sentence, a picture and a figure to only a desired person such as a lover or a special person and a method of manufacturing the same.

It is another object of the present invention to provide a secret scratch sticker which can be attached to a visiting card or a leaflet so that people can advertise themselves in a special way, and to provide a method of manufacturing the same.

To accomplish the above object, according to one aspect of the present invention, there is provided a secret scratch sticker comprising; a transparent film sheet having an adhesion portion formed on one surface thereof; a first scratching part laminated on the other surface of the film sheet so as to be stripped off with a fingernail or a coin; and a second scratching part laminated on the first scratching part so as to be stripped off together with the first scratching part, the second scratching part having colors.

The first scratching part may include scratching ink and anone cyclohexanone, and be printed and laminated on the film sheet.

The second scratching part may be printed and laminated on the first scratching part using PVC ink or acryl ink.

The second scratching part may include winter green oil.

The secret scratch sticker may be attached to a delivering medium including a separable message input plate.

The delivering medium may include a card, a post card, letter paper, a leaflet or a visiting card.

To accomplish the above object, according to another aspect of the present invention, there is also provided a method of manufacturing a secret scratch sticker, the method comprising the steps of: preparing a film sheet having an adhesion portion formed on one surface thereof; manufacturing a silk screen suitable for a desired pattern; printing a first scratching part on the film sheet using the silk screen; printing a second scratching part on the first scratching part; and cutting the film sheet on which the first and second scratching parts are laminated using Thomson molding.

The first scratching part may include scratching ink and anone cyclohexanone and printed.

The second scratching part may be printed and laminated on the first scratching part using PVC ink or acryl ink.

The second scratching part may further include winter green oil.

The Thomson molding step may use a cutting and creasing die.

According to the present invention, a user can deliver a desired message to only a desired person, and thus the message can be hidden from other people.

Furthermore, an envelope is not used to hide the message so that unnecessary waste can be prevented.

Moreover, the thought of the user can be intensively delivered to the person who receives the message because when the person scratches a scratching part of the secret scratch sticker, they may have excitement or expectation. In addition, since a special delivering medium is used, the thought of the user can be delivered to the person who receives the message in a romantic manner.

Moreover, the secret scratch sticker can be formed in various patterns and colors, and thus post cards or cards can be manufactured in various, beautiful and unique designs.

Furthermore, the message can be easily hidden because the scratching part is not easily scratched with weak force. In addition, the scratching part can be used cleanly because it does not become hand-stained.

Moreover, the secret scratch sticker can be attached to a visiting card or a leaflet and delivered to people to advertise the person who owns the visiting card or the leaflet in a special and individual way.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
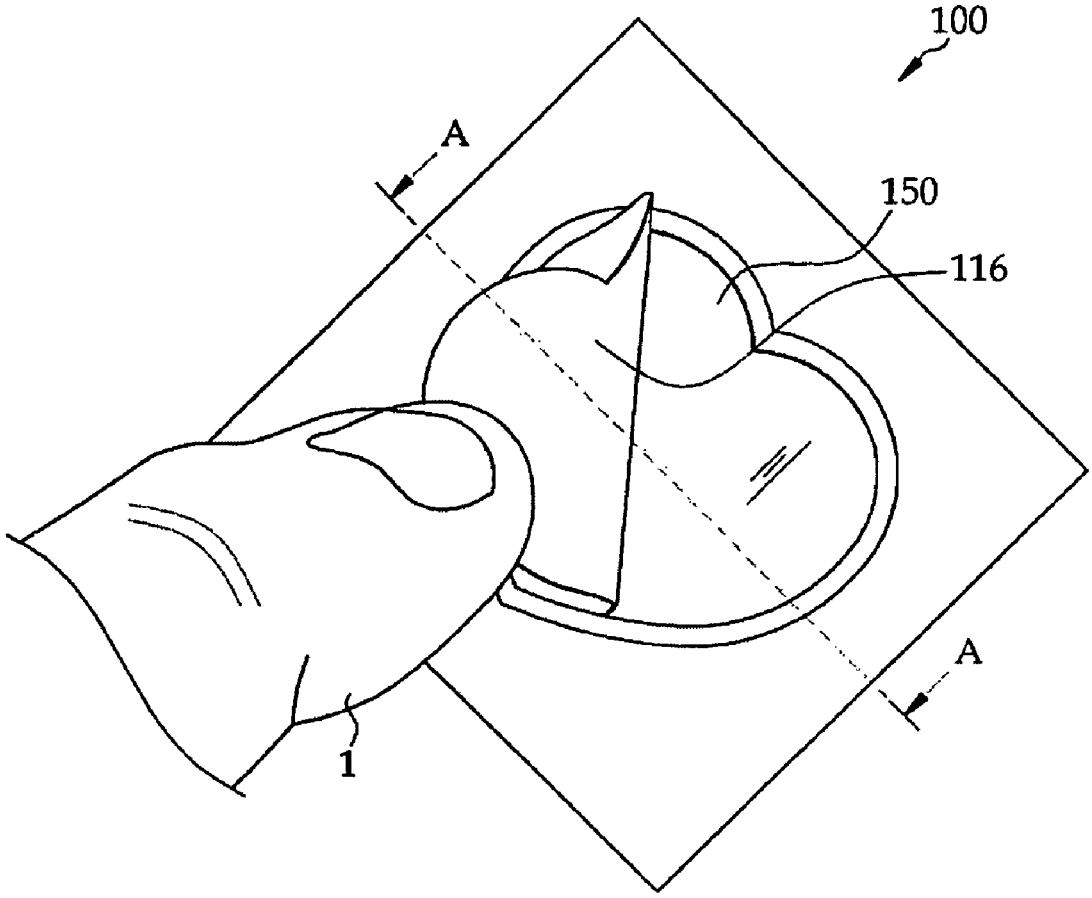
FIG. 1 is a perspective view illustrating a process of stripping off a secret scratch sticker according to the present invention from a vinyl coating sheet.

Hereinafter, the present invention will be described in detail by explaining preferred embodiments of the invention with reference to the attached drawings. Like reference numerals in the drawings denote like elements. The invention may, however, be embodied in many difference forms and should not be construed as being limited to the embodiments set forth herein; rather, these embodiments are provided so that this disclosure will be thorough and complete, and will fully convey the concept of the invention to those skilled in the art.

Figure 2:
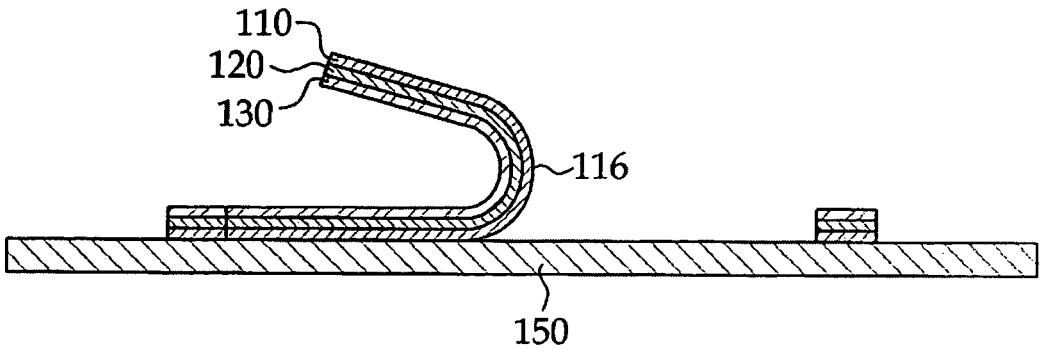
FIG. 2 is a cross-sectional view taken along the line A-A of FIG. 1.

FIG. 1 is a perspective view illustrating a process of stripping off a secret scratch sticker 100 according to the present invention from a vinyl coating sheet 150 and FIG. 2 is a cross-sectional view taken along the line A-A of FIG. 1. Referring to FIGS. 1 and 2, the secret scratch sticker 100 according to the present invention includes a film sheet 110, a first scratching part 120 and a second scratching part 130.

The film sheet 110 has an adhesion portion 116 formed on one surface thereof and is attached to the vinyl coating sheet 150. The first scratching part 120 and the second scratching part 130 are sequentially laminated on the other surface of the film sheet 110. The film sheet 110 is transparent and the bottom face of the film sheet 110 can be seen when the first and second scratching parts 120 and 130 are stripped off. That is, the film sheet 110 has transparency as high as light transmits the film sheet 110 such that a message of a delivering medium located under the film sheet 110 can be seen with the naked eye.

The first scratching part 120 is made of an opaque material and laminated on the film sheet 110, and thus the message written on the delivering medium is not seen. The first scratching part 120 is stripped off from the film sheet 110 when scratched with a fingernail or a coin.

The second scratching part 130 is laminated on the first scratching part 120 and stripped off together with the first scratching part 120 when the first scratching part 120 is scratched with a fingernail or a coin. The second scratching part 120 can be represented in various colors including red, blue and green to stimulate the sense of beauty of a person who sees the secret scratch sticker.

The person who sends the message strips off the secret scratch sticker 100 from the vinyl coating sheet 150 with his hand if required.

In the present invention, the delivering medium can be one of a card, a post card, letter paper, a leaflet and a visiting card. The delivering medium is not limited to the aforementioned ones and can be any one that can hide a message using the secret scratch sticker 100. Furthermore, the present invention can be used for an instant lottery ticket.

A process of manufacturing the secret scratch sticker according to an embodiment of the present invention will now be explained.

Figure 3:
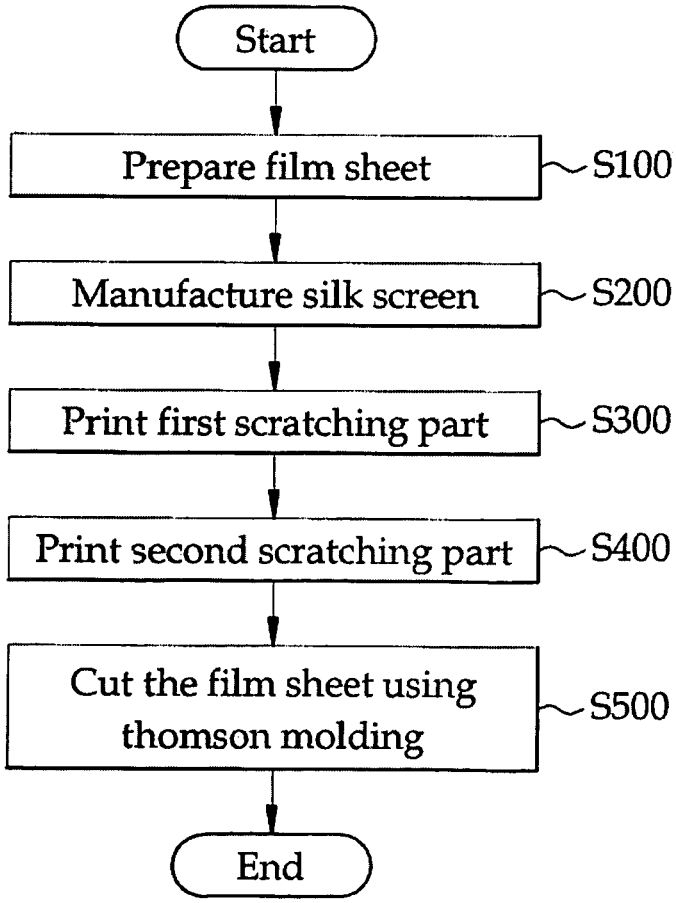
FIG. 3 is a flow chart of a process of manufacturing the secret scratch sticker according to the present invention.

FIG. 3 is a flow chart of the process of manufacturing the secret scratch sticker. Referring to FIGS. 2 and 3, the transparent film sheet 110 is prepared in step S100. Here, the film sheet 110 has the adhesion portion formed on the bottom face thereof, and thus the film sheet 110 is attached to the vinyl coating sheet 150. If required, the film sheet 110 is stripped off from the vinyl coating sheet 150 to be used.

A silk screen is manufactured according to a desired pattern in step S200. For example, a heart figure can be formed and a message written in the heart figure can be sent to a lover. The silk screen is manufactured in various patterns including a heart or a star according to the use and purpose of the secret scratch sticker.

The silk screen is a printing tool which is widely used to print posters, bill, characters and the like because the silk screen obtains distinct and intense products using ink uniformly adhering to a silk screen plate.

The first scratching part 120 is printed on the film sheet 110 using the silk screen in step S300. The printed first scratching part 120 includes scratching ink and anone cyclohexanone.

The scratching ink (also referred to as lottery ticket ink) is generally used for an instant lottery ticket which is scratched to instantly confirm winning and easily stripped off when scratched using a fingernail or a tool such as a coin.

The anone cyclohexanone is an ink diluent and reduces the fluidity or spinability of ink. An ink printing operation can be improved when a proper quantity of diluent is used.

After the first scratching part 120 is printed on the film sheet 110 using the silk screen, the second scratching part 130 is printed in step S400. Here, PVC ink or acryl ink in a desired color is selected and silk-screen-printed.

The PVC ink or acryl ink is clean because it does not become hand-stained. Furthermore, the PVC ink or acryl ink is high-glossy, widely used and economical. The PVC ink or acryl ink includes winter green oil. The winter green oil is a delaying agent that delays drying of ink, prevents a silk screen plate from being filled up due to rapid drying of ink when the ink is silk-screen-printed and improves flexibility of silk screen printing. The winter green oil is added to the ink and printed.

The printed sticker is cut through a Thomson molding operation using a cutting and creasing die in step S500. The Thomson molding operation cuts only the first and second scratching parts 120 and 130 laminated on the film sheet 110. That is, the first and second scratching parts 120 and 130 and the film sheet 110 other than the vinyl coating sheet 150 are cut, and thus the sticker can be easily stripped off from the vinyl coating sheet 150 with a hand.

The aforementioned printing operation is well known in the art so that detailed explanation thereof is omitted.

A method of using the secret scratch sticker according to an embodiment of the present invention will now be explained.

The secret scratch sticker 100 manufactured as above is used as follows.

Figure 4:
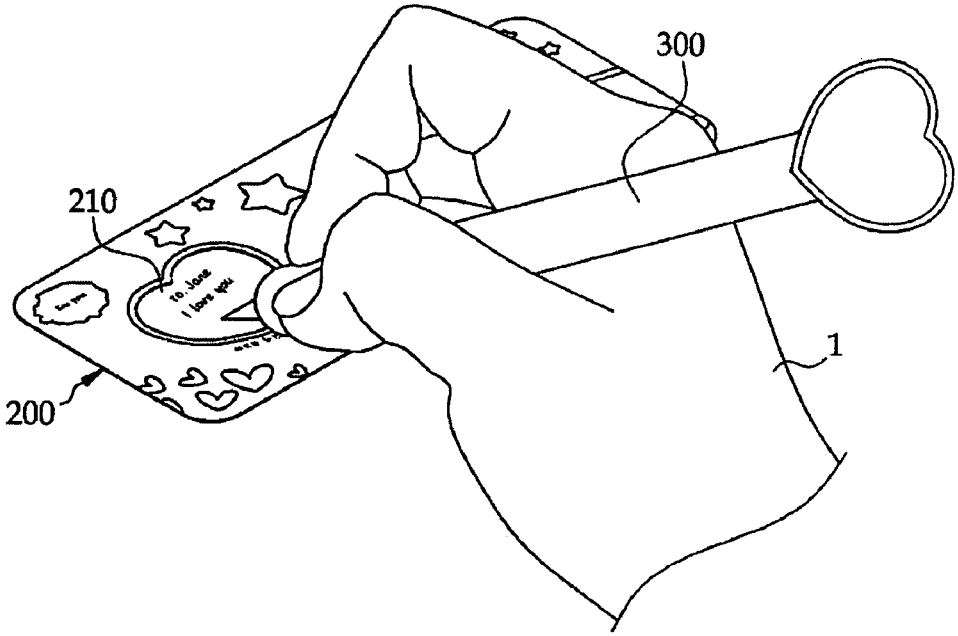
FIG. 4 illustrates writing a desired message on a sticker-attached portion of a predetermined card.

FIG. 4 illustrates that a user writes a desired message on a sticker-attached portion 210 of a predetermined card 200. Referring to FIG. 4, the user personally writes a message that the user wants to send to a receiving party with his hand 1 on the sticker-attached portion 210 of the card 200 using a pen 300. Various kinds of cards, post cards or letter paper having the sticker-attached portion 210 on which a user can write a message for a birthday or an anniversary can be sold together with the secret scratch sticker 100 adhering to the sticker-attached portion 210 such that the user can purchase a set of the secret scratch sticker and a card, a post card or letter paper according to the purpose of using the set. The use of the secret scratch sticker according to the present invention is not limited to the cards, post cards and letter paper and the secret scratch sticker can be used to hide any message.

Figure 5:
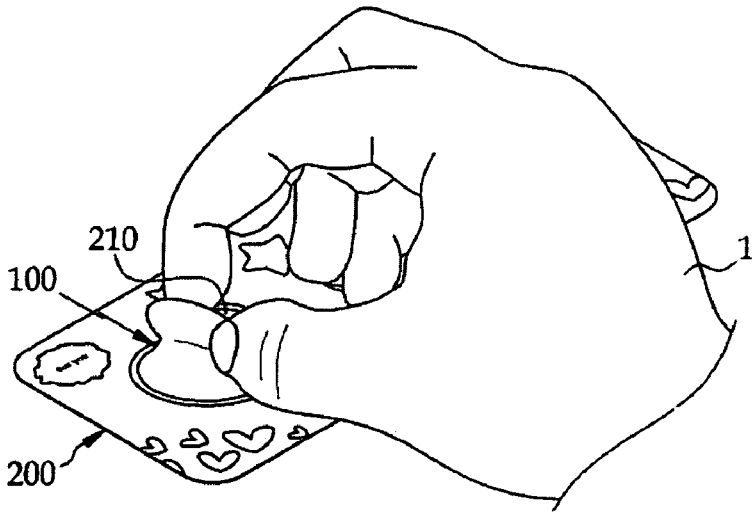
FIG. 5 illustrates attaching the secret scratch sticker according to the present invention to the card on which the message is written illustrated in FIG. 4.

FIG. 5 illustrates attachment of the secret scratch sticker 100 according to the present invention to the card 200 on which the message is written as illustrated in FIG. 4. Referring to FIG. 5, the user attaches the opaque secret scratch sticker 100, which is stripped off from the vinyl coating sheet 150 with his hand 1, to the sticker-attached portion 210 after writing the message on the card 200 to hide the message. That is, the adhesion portion 116 of the film sheet 110 is attached to the card 200 corresponding to a delivering medium.

Figure 6:
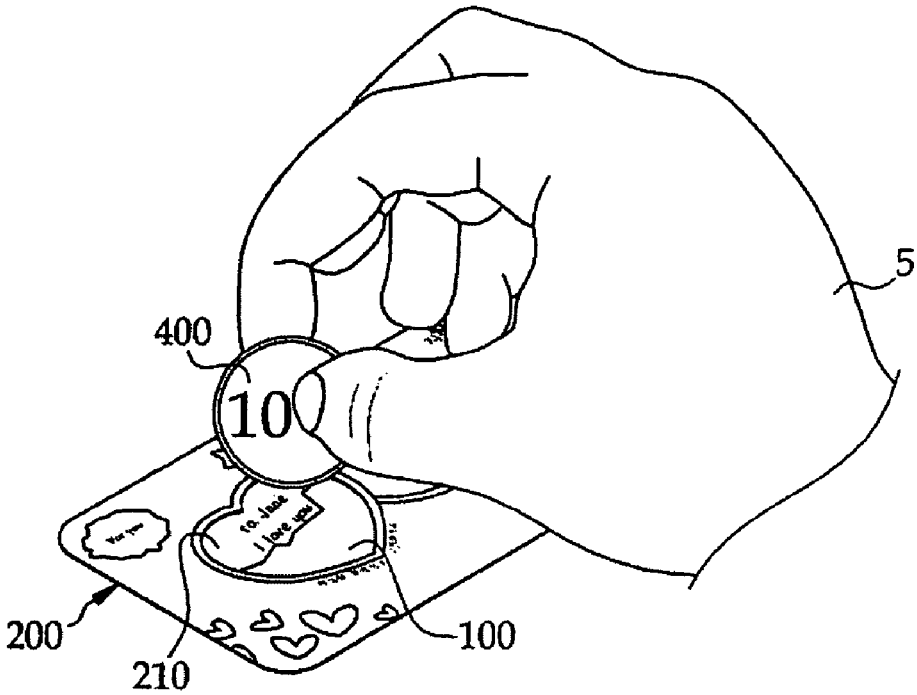
FIG. 6 illustrates that a person who receives the card illustrated in FIG. 5 strips off first and second scratching parts of the secret scratch sticker using a coin.

FIG. 6 illustrates that a person who receives the card 200 strips off the first and second scratching parts of the secret scratch sticker using a coin 400. Referring to FIG. 6, the person who receives the card 200 scratches the scratching parts using the coin 400 or a fingernail to strip off the scratching parts. Specifically, the topmost second scratching part 130 is stripped off by the coin 400 or a fingernail and the first scratching part 120 is stripped off together with the second scratching part 130, and thus the person who receives the card 200 can see the message written on the card 200.

Figure 7:
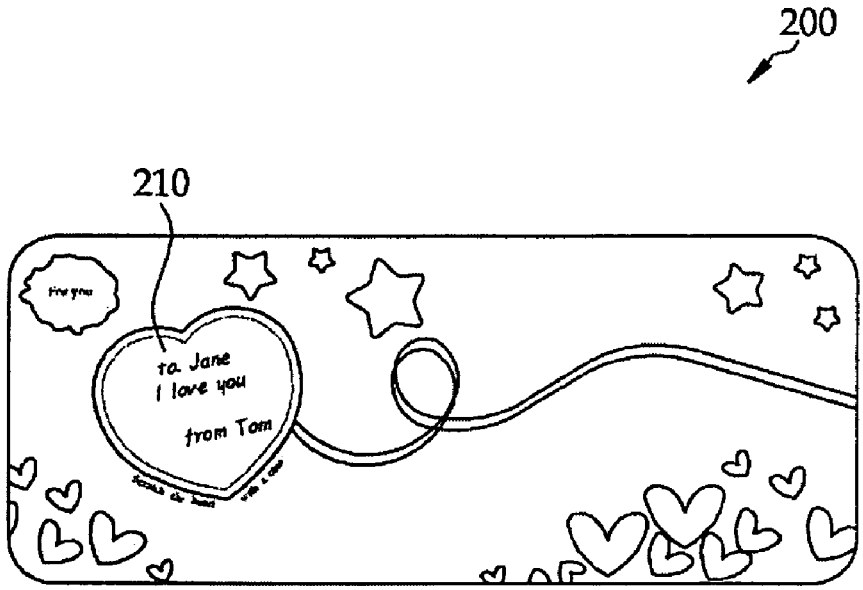
FIG. 7 illustrates that the first and second scratching parts of the secret scratch sticker are stripped off and only a transparent film sheet is attached to the card illustrated in FIG. 4.

FIG. 7 illustrates that the first and second scratching parts of the secret scratch sticker are stripped off and only the transparent film sheet is attached to the secret scratch sticker. Referring to FIG. 7, when the scratching parts of the card 200 are completely scratched off, the message is exposed and it can be read with the eyes. That is, the person who receives the card 200 scratches the scratching parts in a psychological state similar to the excitement or expectation they may feel when they scratch a lottery ticket, and thus the person can receive the card with great expectation.

Furthermore, since the second scratching part 130 is coated such that the secret scratch sticker hardly becomes hand-stained and various colors are added to the card, the card is visually beautiful and can be used for various purposes. Moreover, the scratching parts are not scratched with weak force so that the message can be perfectly hidden.

Figure 8:
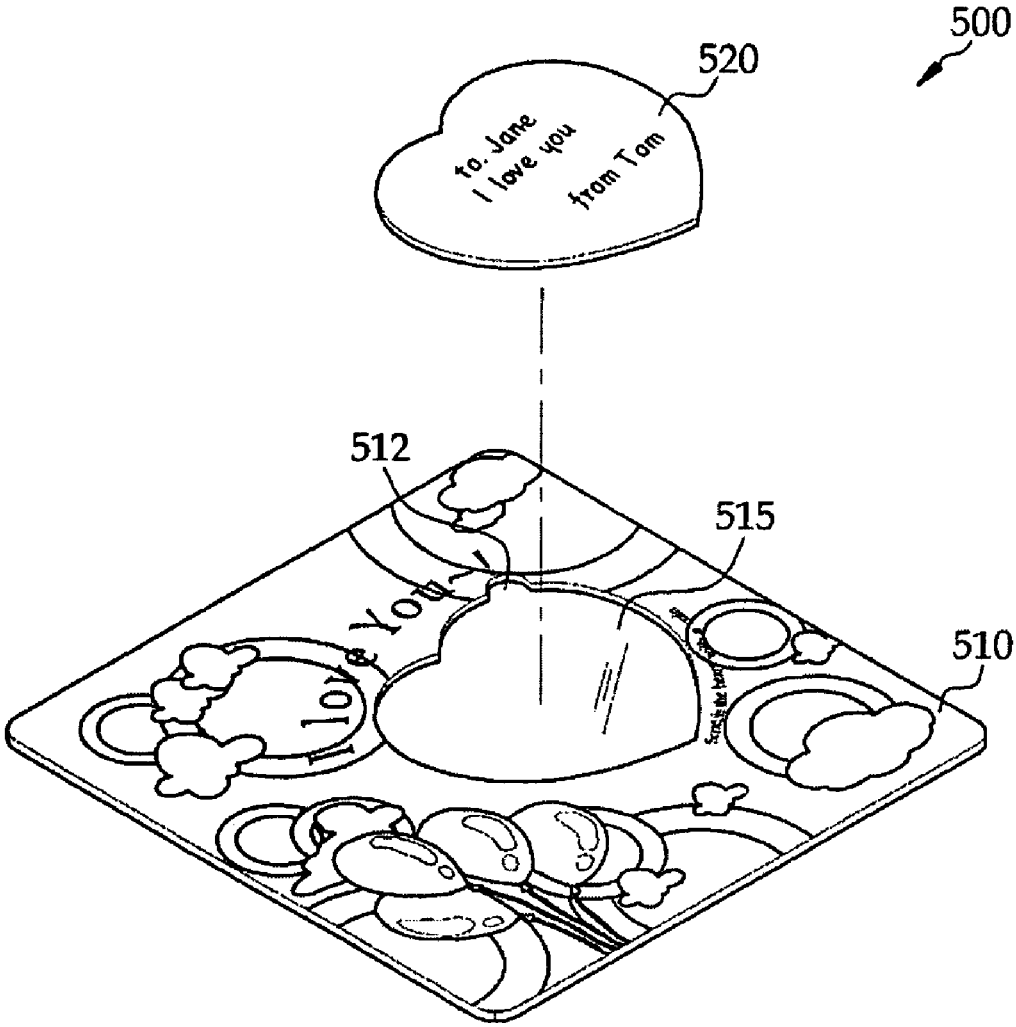
FIG. 8 is a perspective view of a card corresponding to another delivering medium to which the secret scratch sticker of the present invention can be applied.

FIG. 8 is a perspective view illustrating a card 500 corresponding to another delivering medium to which the secret scratch sticker of the present invention can be applied. Referring to FIG. 8, the secret scratch sticker 100 can be used for the card 500 including a message input plate 520. That is, an input plate mounting part 515 is formed in a card body 510 and the message input plate 520 having the same shape as the input plate mounting part 515 is combined with the input plate mounting part 515. An input plate separating recess 512 for separating the message input plate 520 from the input plate mounting part 515 is formed at one side of the input plate mounting part 515.

Figure 9:
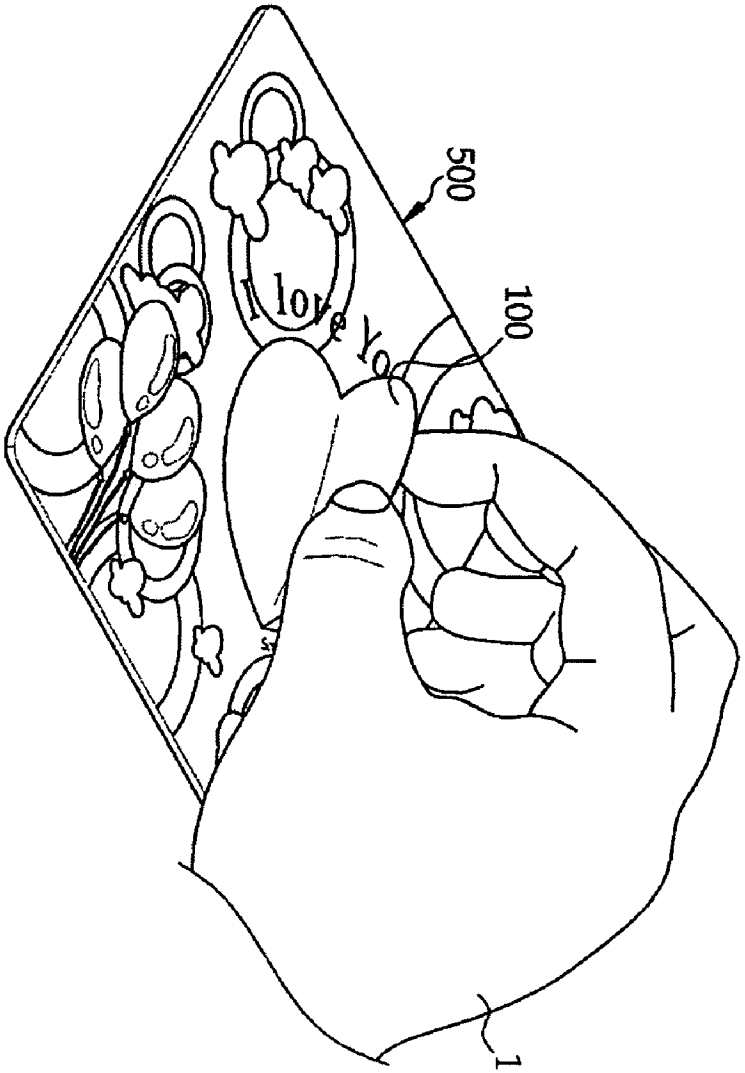
FIG. 9 illustrates that a user writes a message on a message input plate illustrated in FIG. 8 and then attaches the secret scratch sticker according to the present invention to the message input plate.

FIG. 9 illustrates that a user writes a message on the message input plate 520 of the card 500 as illustrated in FIG. 8 and then attaches the secret scratch sticker according to the present invention to the card 500. Referring to FIG. 9, the user inputs a message to the message input plate 520, sets the message input plate 520 in the input plate mounting part 515, attaches the secret scratch sticker 100 stripped off from the vinyl coating sheet 150 to the surface of the message input plate 520 with the hand 1 and sends the card 500. A person who receives the card 500 strips off a scratching part of the secret scratch sticker 100 to confirm the message. The person who receives the card 500 can separate the message input plate 520 including the message from the input plate mounting part 515, write a message on a new message input plate 520, set the new message input plate 520 in the message mounting part 515, attach the secret scratch sticker 100 to the card and deliver the card to the person who sent the card 500. That is, the used message input plate 520 can be replaced with a new message input plate, and thus the card 500 can be used multiple times, which is economical. Here, the message input plate 520 is tightly set in the input plate mounting part 515, and thus the message input plate 520 is separated from the input plate mounting part 515 using the input plate separating recess 512.

The secret scratch sticker 100 of the present invention can be attached to a delivering medium on which characters are previously printed, such as a visiting card or a leaflet, as well as a delivering medium on which a user handwrites a message such as the cards 200 and 500 and letter paper to improve the advertising effect.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A secret scratch sticker comprising:

a transparent film sheet 110 defining two opposing surfaces having an adhesion portion 116 formed on one of the surfaces thereof;

a first scratching part 120 laminated on the other surface of the film sheet 110 so as to be stripped off with a fingernail or a coin, the first scratching part 120 including scratching ink and anone cyclohexanone; and a second scratching part 130 printed and laminated on the first scratching part 120 using PVC ink or acryl ink so as to be stripped off together with the first scratching part 120, the PVC ink or acryl ink having colors and including winter green oil, wherein the secret scratch sticker is attached to a delivering medium including a card, a postcard, letter paper, a leaflet or a visiting card.

2. A method of manufacturing a secret scratch sticker, the method comprising:

preparing a film sheet 100 defining two opposing surfaces and having an adhesion portion 116 formed on one of the surfaces thereof;

manufacturing a silk screen suitable for a desired pattern;

printing a first scratching part 120 on the other surface of the film sheet 110 using scratching ink and anone cyclohexanone on the silk screen;

printing a second scratching part 130 on the first scratching part 120 using PVC ink or acryl ink including winter green oil; and cutting the film sheet 110 on which the first and second scratching parts 120 and 130 are laminated using molding.

* * * * *